US010566110B2

(12) United States Patent
Kaczmarski et al.

(10) Patent No.: US 10,566,110 B2
(45) Date of Patent: Feb. 18, 2020

(54) CHANNELED INSULATION FOR TELECOMMUNICATION CABLE

(71) Applicant: Sterlite Technologies Limited, Aurangabad (IN)

(72) Inventors: Andrew Kaczmarski, Casula (AU); Darshana Bhatt, Aurangabad (IN); Avnish Dube, Aurangabad (IN)

(73) Assignee: STERLITE TECHNOLOGIES LIMITED, Aurangabad, MH (IN)

( * ) Notice: Subject to any disclaimer, the term of this patent is extended or adjusted under 35 U.S.C. 154(b) by 0 days.

(21) Appl. No.: 16/019,895

(22) Filed: Jun. 27, 2018

(65) Prior Publication Data

US 2019/0006063 A1 Jan. 3, 2019

(30) Foreign Application Priority Data

Jun. 29, 2017 (IN) ..... 201721022741

(51) Int. Cl.

| | |
|---|---|
| ***H01B 7/00*** | (2006.01) |
| ***H01B 7/02*** | (2006.01) |
| ***H01B 11/12*** | (2006.01) |
| *H01B 11/00* | (2006.01) |

(52) U.S. Cl.

CPC ..... *H01B 7/0275* (2013.01); *H01B 7/0233* (2013.01); *H01B 11/12* (2013.01); *H01B 7/0291* (2013.01); *H01B 11/002* (2013.01)

(58) Field of Classification Search

CPC .... H01B 7/0275; H01B 7/0233; H01B 11/12; H01B 7/0291; H01B 11/002; H01B 11/02; H01B 3/00; H01B 7/02; H01B 7/00; H01B 7/0009; H01B 7/04

USPC ..... 174/138 R, 113 R, 113 AS, 115, 116, 174/120 R, 120 SR, 113 C, 68.1, 68.3, 174/72 A, 110 R, 137 R

See application file for complete search history.

(56) References Cited

U.S. PATENT DOCUMENTS

| | | | | |
|---|---|---|---|---|
| 5,990,419 A * | 11/1999 | Bogese, II | ..... | H01B 7/184 174/113 R |
| 6,743,983 B2 * | 6/2004 | Wiekhorst | ..... | H01B 11/002 174/102 SP |
| 7,049,519 B2 * | 5/2006 | Wiekhorst | ..... | H01B 7/0233 174/113 R |
| 7,135,641 B2 * | 11/2006 | Clark | ..... | H01B 7/184 174/110 R |
| 7,405,360 B2 * | 7/2008 | Clark | ..... | H01B 11/06 174/113 AS |

(Continued)

*Primary Examiner* — Angel R Estrada

(57) ABSTRACT

The present disclosure relates to a telecommunications cable. The telecommunication cable includes a plurality of twisted pairs of insulated wires extending substantially along a longitudinal axis of the telecommunications cable. Each insulated wire of the plurality of twisted pairs of insulated wires includes a conductor and an insulation surrounding the conductor. The insulation includes a first insulation layer defining a plurality of channels disposed around a peripheral surface of the conductor. In addition, the insulation includes a second insulation layer disposed circumferentially around the first insulation layer. Moreover, the insulation includes a third insulation layer disposed circumferentially around the second insulation layer. Furthermore, the telecommunication cable includes a separator and a first layer defining the outer jacket of the telecommunication cable.

30 Claims, 3 Drawing Sheets

(56) References Cited

U.S. PATENT DOCUMENTS

| | | | | |
|---|---|---|---|---|
| 7,511,225 | B2 * | 3/2009 | Wiekhorst | H01B 7/0233 174/113 R |
| 7,581,565 | B1 * | 9/2009 | Torrance | F16L 9/147 138/110 |
| 7,954,518 | B2 * | 6/2011 | Torrance | F16L 13/0272 138/110 |
| 8,022,302 | B2 * | 9/2011 | Juengst | H01B 7/0233 174/110 R |
| 9,870,846 | B2 * | 1/2018 | Juengst | H01B 7/0233 |

* cited by examiner

CHANNELED INSULATION FOR TELECOMMUNICATION CABLE

TECHNICAL FIELD

The present disclosure, relates to the field of telecommunication cables. More particularly, the present disclosure relates to a telecommunication cable having a channeled insulation. The present application is based on, and claims priority from an Indian Application Number 201721022741 filed on 29 Jun. 2017 the disclosure of which is hereby incorporated by reference herein.

BACKGROUND

With an increase in utilization of complex communication and networking systems, the demand for transmitting signals at high transmission rates has increased. In order to meet the growing demands, various types of telecommunication cables are widely used for transmitting signals which are compliant with high-performance data standards. One such widely used telecommunication cables are UTP (unshielded twisted pair) cables. Typically, a UTP cable includes one or more twisted pairs of conductors enclosed within an outer jacket. Each twisted pair of the one or more twisted pairs of conductors are used for transmitting signals. Further, each twisted pairs of conductors includes an insulation for protecting the conductors. Furthermore, a dielectric constant of an insulation surrounding the conductor of each of the twisted pairs is one of a significant factor affecting the signal transmission performance of the UTP cable. To improve signal transmission performance of the UTP cable, it is desirable to lower the dielectric constant of the insulation. Lowering the dielectric constant of the insulation results in an increase in the signal transmission rate inside the UTP cable.

In one of a prior art with U.S. Pat. No. 6,743,983 B2, a telecommunications cable is provided. The telecommunication cable includes a conductor which extends along a longitudinal axis and an insulation having channels surrounding the conductor. At least one channel in the insulation extends generally along the longitudinal axis to form an insulated conductor. Providing at least one channel in the insulation increases air content and lowers the effective dielectric constant of the insulator. However, the addition of too much air channels to the insulator results in poor mechanical and physical properties. For example, if too much air is present in an insulator, the insulator may be prone to crushing. Presently, several attempts are made to provide an insulation with low dielectric constant. One such approach is to increase the thickness of the insulation surrounding the conductor. However, this approach creates issues with inequality of pair-to-pair impedance and propagation speed resulting in cable-to-component mismatch and return loss problems.

In light of the above-stated discussion, there exists a need for an insulation which overcomes the above-cited drawbacks of conventionally known telecommunication cables.

SUMMARY

This Summary is provided to introduce a selection of concepts in a simplified form that are further described below in the Detailed Description. This Summary is not intended to identify key or essential features of the claimed subject matter, nor is it intended to be used as an aid in determining the scope of the claimed subject matter.

In an aspect, the present disclosure provides an insulation for conductor. The insulation includes a first insulation layer defining a plurality of channels disposed around a peripheral surface of the conductor. In addition, the insulation includes a second insulation layer disposed circumferentially around the first insulation layer. Moreover, the insulation includes a third insulation layer disposed circumferentially around the second insulation layer. Further, the first insulation layer includes a first circumferential wall and a second circumferential wall spaced radially inwardly from the first circumferential wall. The plurality of channels is defined between the second circumferential wall and the peripheral surface of the conductor.

In an embodiment of the present disclosure, the first insulation layer is formed of a material selected from a group consisting of solid polyolefin, polypropylene and fluorinated ethylene propylene. The first insulation layer has a first radial thickness in a range of about 0.01 millimeters to 0.07 millimeters.

In an embodiment of the present disclosure, the second insulation layer is formed of a material selected from a group consisting of solid or foamed polyolefin, solid or foamed polypropylene and fluorinated ethylene propylene. The second insulation layer has a second radial thickness in a range of about 0.17 millimeters to 0.3 millimeters.

In an embodiment of the present disclosure, the third insulation layer is formed of a material selected from a group consisting of solid polyolefin, polypropylene and fluorinated ethylene propylene. The third insulation layer has a third radial thickness in a range of about 0.01 millimeters to 0.07 millimeters.

In an embodiment of the present disclosure, each of the plurality of channels has a cross-sectional shape selected from a group consisting of sinusoidal, semicircular, square, rectangular, trapezoidal and arched.

In an embodiment of the present disclosure, the plurality of channels disposed around the peripheral surface of the conductor is in a number range of about 3 to 12.

In an embodiment of the present disclosure, the second insulation layer is disposed around the first insulation layer such that the second insulation layer is in substantially continuous contact with the first circumferential wall of the first insulation layer.

In another aspect, the present disclosure provides a telecommunications cable. The telecommunication cable includes a plurality of twisted pairs of insulated wires extending substantially along a longitudinal axis of the telecommunications cable. Each insulated wire of the plurality of twisted pairs of insulated wires includes at least one conductor and an insulation surrounding the conductor. Further, the telecommunication cable includes a separator for separating each twisted pair of insulated wire of the plurality of twisted pairs of insulated wires. Furthermore, the telecommunication cable includes a first layer surrounding the separator and the plurality of twisted pairs of insulated wires along the length of the telecommunications cable. The conductor is made of copper. The insulation includes a first insulation layer defining a plurality of channels disposed around a peripheral surface of the conductor. In addition, the insulation includes a second insulation layer disposed circumferentially around the first insulation layer. Moreover, the insulation includes a third insulation layer disposed circumferentially around the second insulation layer. Further, the first insulation layer includes a first circumferential wall and a second circumferential wall spaced radially inwardly from the first circumferential wall. The plurality of channels is defined between the second circumferential wall and the peripheral surface of the conductor.

In an embodiment of the present disclosure, the conductor has a cross sectional diameter in a range of about 0.49 millimeters to 0.69 millimeters.

In an embodiment of the present disclosure, the first insulation layer is formed of a material selected from a group consisting of solid polyolefin, polypropylene and fluorinated ethylene propylene. In addition, the first insulation layer has a first radial thickness in a range of about 0.01 millimeters to 0.07 millimeters.

In an embodiment of the present disclosure, the second insulation layer is formed of a material selected from a group consisting of polyolefin, polypropylene and fluorinated ethylene propylene. In addition, the second insulation layer has a second radial thickness in a range of about 0.17 millimeters to 0.3 millimeters.

In an embodiment of the present disclosure, the third insulation layer is formed of a material selected from a group consisting of solid polyolefin, polypropylene and fluorinated ethylene propylene. In addition, the third insulation layer has a third radial thickness in a range of about 0.01 millimeters to 0.07 millimeters.

In an embodiment of the present disclosure, the telecommunications cable further includes one or more ripcords placed inside a core of the telecommunications cable. The one or more ripcords lie substantially along the longitudinal axis of the telecommunications cable. The one or more ripcords facilitate stripping of the first layer. The one or more ripcords are made of a material selected from a group. The group consists of nylon and polyester based twisted yarns.

In an embodiment of the present disclosure, each of the plurality of channels between the second circumferential wall and the peripheral surface of the conductor defines a void space containing air.

In an embodiment of the present disclosure, the telecommunication cable has a cross-sectional outer diameter in a range of 5 millimeters to 9 millimeters.

In an embodiment of the present disclosure, the plurality of channels has a cross-sectional shape selected from a group consisting of sinusoidal, semicircular, square, rectangular, trapezoidal and arched.

In an embodiment of the present disclosure, the plurality of channels disposed around the peripheral surface of the conductor is in a number range of about 3 to 12.

In an aspect, the present disclosure provides an insulation for conductor. The insulation includes a first insulation layer defining a plurality of channels disposed around a peripheral surface of the conductor. In addition, the insulation includes a second insulation layer disposed circumferentially around the first insulation layer. Moreover, the insulation includes a third insulation layer disposed circumferentially around the second insulation layer. Further, the first insulation layer includes a first circumferential wall and a second circumferential wall spaced radially inwardly from the first circumferential wall. The plurality of channels is defined between the second circumferential wall and the peripheral surface of the conductor. Further, the first insulation layer is formed of a material selected from a group consisting of solid polyolefin, polypropylene and fluorinated ethylene propylene. In addition, the second insulation layer is formed of a material selected from a group consisting of solid or foamed polyolefin, solid or foamed polypropylene and fluorinated ethylene propylene. Also, the third insulation layer is formed of a material selected from a group consisting of solid polyolefin, polypropylene and fluorinated ethylene propylene. Furthermore, the first insulation layer has a first radial thickness in a range of about 0.01 millimeters to 0.07 millimeters. The second insulation layer has a second radial thickness in a range of about 0.17 millimeters to 0.3 millimeters. The third insulation layer has a third radial thickness in a range of about 0.01 millimeters to 0.07 millimeters.

In an embodiment of the present disclosure, each of the plurality of channels has a cross-sectional shape selected from a group consisting of sinusoidal, semicircular, square, rectangular, trapezoidal and arched.

In an embodiment of the present disclosure, the plurality of channels disposed around the peripheral surface of the conductor is in a number range of about 3 to 12.

In an embodiment of the present disclosure, the second insulation layer is disposed around the first insulation layer such that the second insulation layer is in substantially continuous contact with the first circumferential wall of the first insulation layer.

In another aspect, the present disclosure provides a telecommunications cable. The telecommunication cable includes a plurality of twisted pairs of insulated wires extending substantially along a longitudinal axis of the telecommunications cable. Each insulated wire of the plurality of twisted pairs of insulated wires includes at least one conductor and an insulation surrounding the conductor. Further, the telecommunication cable includes a separator for separating each twisted pair of insulated wire of the plurality of twisted pairs of insulated wires. Furthermore, the telecommunication cable includes a first layer surrounding the separator and the plurality of twisted pairs of insulated wires along the length of the telecommunications cable. The conductor is made of copper. In addition, the conductor has a cross sectional diameter in a range of about 0.49 millimeters to 0.69 millimeters. The insulation includes a first insulation layer defining a plurality of channels disposed around a peripheral surface of the conductor. In addition, the insulation includes a second insulation layer disposed circumferentially around the first insulation layer. Moreover, the insulation includes a third insulation layer disposed circumferentially around the second insulation layer. Further, the first insulation layer includes a first circumferential wall and a second circumferential wall spaced radially inwardly from the first circumferential wall. The plurality of channels is defined between the second circumferential wall and the peripheral surface of the conductor. Further, the first insulation layer is formed of a material selected from a group consisting of solid polyolefin, polypropylene and fluorinated ethylene propylene. In addition, the second insulation layer is formed of a material selected from a group consisting of polyolefin, polypropylene and fluorinated ethylene propylene. Also, the third insulation layer is formed of a material selected from a group consisting of solid polyolefin, polypropylene and fluorinated ethylene propylene. Furthermore, the first insulation layer has a first radial thickness in a range of about 0.01 millimeters to 0.07 millimeters. The second insulation layer has a second radial thickness in a range of about 0.17 millimeters to 0.3 millimeters. The third insulation layer has a third radial thickness in a range of about 0.01 millimeters to 0.07 millimeters.

In an embodiment of the present disclosure, the telecommunications cable further includes one or more ripcords placed inside a core of the telecommunications cable. The one or more ripcords lie substantially along the longitudinal axis of the telecommunications cable. The one or more ripcords facilitate stripping of the first layer. The one or more ripcords are made of a material selected from a group. The group consists of nylon and polyester based twisted yarns.

In an embodiment of the present disclosure, each of the plurality of channels between the second circumferential wall and the peripheral surface of the conductor defines a void space containing air.

In an embodiment of the present disclosure, the telecommunication cable has a cross-sectional outer diameter in a range of 5 millimeters to 9 millimeters.

In an embodiment of the present disclosure, the plurality of channels has a cross-sectional shape selected from a group consisting of sinusoidal, semicircular, square, rectangular, trapezoidal and arched.

In an embodiment of the present disclosure, the plurality of channels disposed around the peripheral surface of the conductor is in a number range of about 3 to 12.

In an aspect, the present disclosure provides an insulation for conductor. The insulation includes a first insulation layer defining a plurality of channels disposed around a peripheral surface of the conductor. In addition, the insulation includes a second insulation layer disposed circumferentially around the first insulation layer. Moreover, the insulation includes a third insulation layer disposed circumferentially around the second insulation layer. Further, the first insulation layer includes a first circumferential wall and a second circumferential wall spaced radially inwardly from the first circumferential wall. The plurality of channels is defined between the second circumferential wall and the peripheral surface of the conductor. Each of the plurality of channels has a cross-sectional shape selected from a group consisting of sinusoidal, semicircular, square, rectangular, trapezoidal and arched. In addition, the plurality of channels disposed around the peripheral surface of the conductor is in a number range of about 3 to 12. Further the first insulation layer is formed of a material selected from a group consisting of solid polyolefin, polypropylene and fluorinated ethylene propylene. Furthermore, the first insulation layer has a first radial thickness in a range of about 0.01 millimeters to 0.07 millimeters. The second insulation layer is disposed around the first insulation layer such that the second insulation layer is in substantially continuous contact with the first circumferential wall of the first insulation layer. In addition, the second insulation layer is formed of a material selected from a group consisting of solid or foamed polyolefin, solid or foamed polypropylene and fluorinated ethylene propylene. Further, the second insulation layer has a second radial thickness in a range of about 0.17 millimeters to 0.3 millimeters. The third insulation layer is formed of a material selected from a group consisting of solid polyolefin, polypropylene and fluorinated ethylene propylene. In addition, the third insulation layer has a third radial thickness in a range of about 0.01 millimeters to 0.07 millimeters.

In another aspect, the present disclosure provides a telecommunications cable. The telecommunication cable includes a plurality of twisted pairs of insulated wires extending substantially along a longitudinal axis of the telecommunications cable. Each insulated wire of the plurality of twisted pairs of insulated wires includes at least one conductor and an insulation surrounding the conductor. Further, the telecommunication cable includes a separator for separating each twisted pair of insulated wire of the plurality of twisted pairs of insulated wires. Furthermore, the telecommunication cable includes a first layer surrounding the separator and the plurality of twisted pairs of insulated wires along the length of the telecommunications cable. The conductor is made of copper. In addition, the conductor has a cross sectional diameter in a range of about 0.49 millimeters to 0.69 millimeters. The insulation includes a first insulation layer defining a plurality of channels disposed around a peripheral surface of the conductor. In addition, the insulation includes a second insulation layer disposed circumferentially around the first insulation layer. Moreover, the insulation includes a third insulation layer disposed circumferentially around the second insulation layer. Further, the first insulation layer includes a first circumferential wall and a second circumferential wall spaced radially inwardly from the first circumferential wall. The plurality of channels is defined between the second circumferential wall and the peripheral surface of the conductor. Each of the plurality of channels between the second circumferential wall and the peripheral surface of the conductor defines a void space containing at least one of air, nitrogen and carbon dioxide. In addition, the plurality of channels has a cross-sectional shape selected from a group consisting of sinusoidal, semicircular, square, rectangular, trapezoidal and arched. Further, the plurality of channels disposed around the peripheral surface of the conductor is in a number range of about 3 to 12. The first insulation layer is formed of a material selected from a group consisting of solid polyolefin, polypropylene and fluorinated ethylene propylene. In addition, the first insulation layer has a first radial thickness in a range of about 0.01 millimeters to 0.07 millimeters. The second insulation layer is formed of a material selected from a group consisting of polyolefin, polypropylene and fluorinated ethylene propylene. In addition, the second insulation layer has a second radial thickness in a range of about 0.17 millimeters to 0.3 millimeters. The third insulation layer is formed of a material selected from a group consisting of solid polyolefin, polypropylene and fluorinated ethylene propylene. In addition, the third insulation layer has a third radial thickness in a range of about 0.01 millimeters to 0.07 millimeters.

In an embodiment of the present disclosure, the telecommunications cable further includes one or more ripcords placed inside a core of the telecommunications cable. The one or more ripcords lie substantially along the longitudinal axis of the telecommunications cable. The one or more ripcords facilitate stripping of the first layer. The one or more ripcords are made of a material selected from a group. The group consists of nylon and polyester based twisted yarns.

BRIEF DESCRIPTION OF FIGURES

Figure 1:
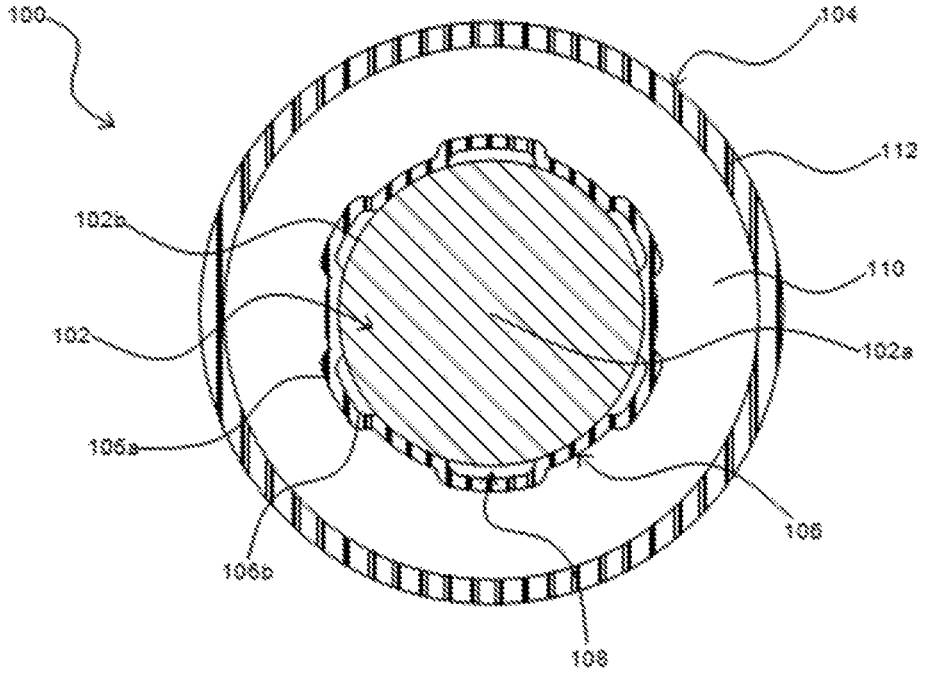
Figure 2:
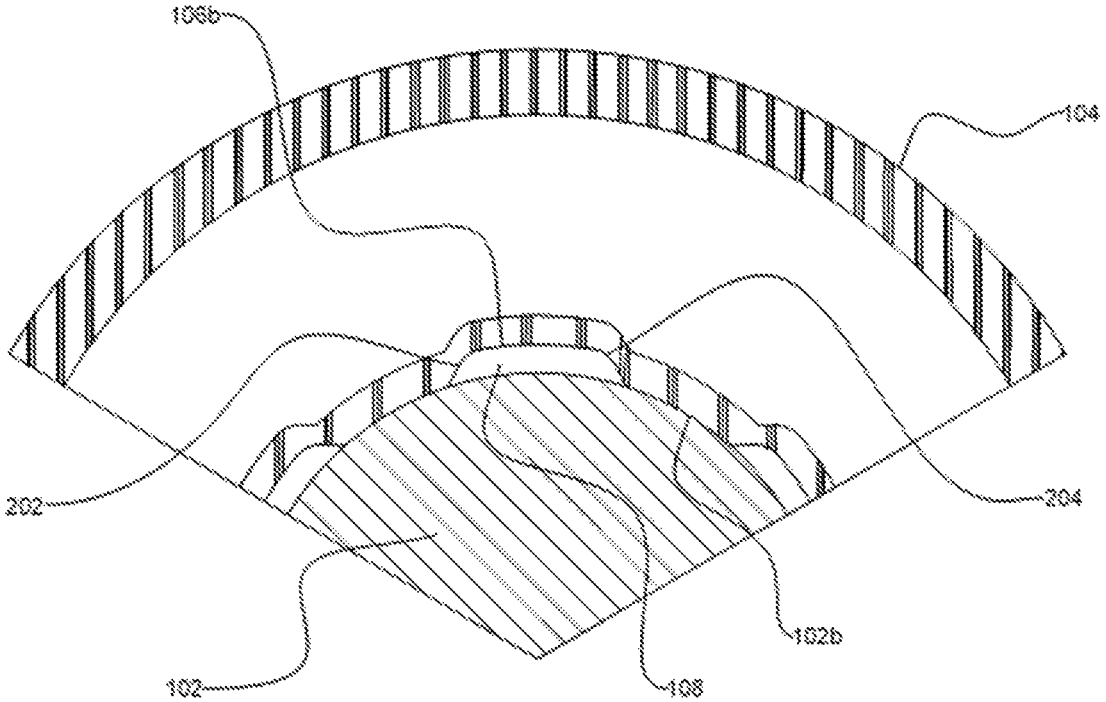
Figure 3:
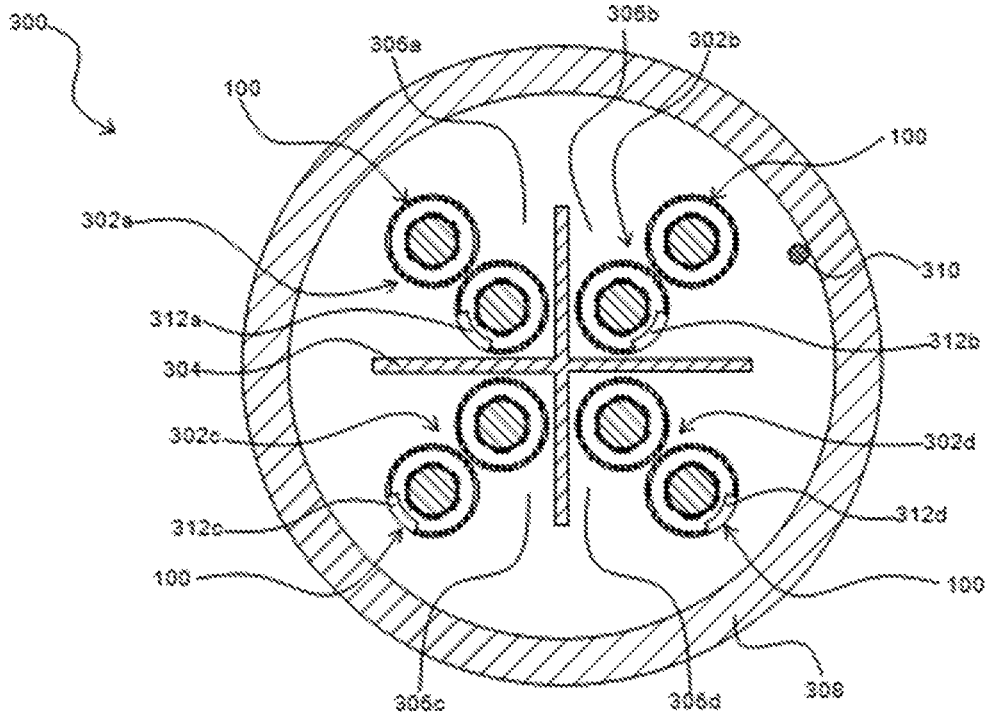

Having thus described the disclosure, in general, terms, reference will now be made to the accompanying figures, wherein:

FIG. 1 illustrates a cross sectional view of an insulated wire, in accordance with an embodiment of the present disclosure;

FIG. 2 illustrates an enlarged sectional view of a first insulation layer associated with an insulation, in accordance with an embodiment of the present disclosure; and FIG. 3 illustrates a cross-sectional view of a telecommunication cable, in accordance with an embodiment of the present disclosure.

It should be noted that the accompanying figures are intended to present illustrations of exemplary embodiments of the present disclosure. These figures are not intended to limit the scope of the present disclosure. It should also be noted that accompanying figures are not necessarily drawn to scale.

DETAILED DESCRIPTION

Reference will now be made in detail to selected embodiments of the present disclosure, in conjunction with accompanying figures. The embodiments described herein are not intended to limit the scope of the disclosure, and the present disclosure, should not be construed as limited to the embodiments described. This disclosure, may be embodied in different forms without departing from the scope and spirit of the disclosure. It should be understood that the accompanying figures are intended and provided to illustrate embodiments of the disclosure, described below and are not necessarily drawn to scale. In the drawings, like numbers refer to like elements throughout, and thicknesses and dimensions of some components may be exaggerated for providing better clarity and ease of understanding.

It should be noted that the terms "first", "second", and the like, herein do not denote any order, ranking, quantity, or importance, but rather are used to distinguish one element from another. Further, the terms "a" and "an" herein do not denote a limitation of quantity, but rather denote the presence of at least one of the referenced item.

FIG. 1 illustrates a cross sectional view of an insulated wire 100, in accordance with an embodiment of the present disclosure. In general, the insulated wires are used in many categories of data transmission, telecommunication, electrical wiring, power generation, power transmission, power distribution and electronic circuitry. The insulated wire 100 is characterized by a pre-defined cross-sectional diameter. In an embodiment of the present disclosure, the pre-defined cross-sectional diameter of the insulated wire 100 is in a range of about 0.8 millimeter to 1.5 millimeters.

Further, the insulated wire 100 includes a conductor 102 and an insulation 104 surrounding the conductor 102. In an embodiment of the present disclosure, the conductor 102 is an electrical conductor. The conductor 102 includes a main body 102*a* and a peripheral surface 102*b*. The main body 102*a* of the conductor 102 includes a longitudinal axis (not shown) passing through a geometrical center of the main body 102*a*. The conductor 102 extends substantially along the longitudinal axis passing through the geometrical center of the main body 102*a*. The conductor 102 is of circular cross-sectional shape. In an embodiment of the present disclosure, the conductor 102 is of any other suitable shape. Further, the conductor 102 is characterized by a cross-sectional diameter. The cross-sectional diameter of the conductor 102 is in a range of about 0.49 millimeters to 0.69 millimeters. In an embodiment of the present disclosure, the cross-sectional diameter of the conductor 102 is about 0.58 millimeters. In another embodiment of the present disclosure, the cross-sectional diameter of the conductor 102 may vary.

The insulated wire 100 includes the insulation 104 surrounding the conductor 102. The insulation 104 includes a first insulation layer 106, a second insulation layer 110 and a third insulation layer 112. The first insulation layer 106, the second insulation layer 110 and the third insulation layer 112 together provides electrical isolation to the conductor 102. The insulation 104 has a pre-defined overall insulation thickness. In an embodiment of the present disclosure, the pre-defined overall insulation thickness is in a range of about 0.19 millimeters to 0.44 millimeters Referring to FIG. 1, the first insulation layer 106 surrounds the peripheral surface 102*b* of the conductor 102. The first insulation layer 106 covers the conductor 102. The first insulation layer 106 has a first radial thickness in a range of about 0.01 millimeters to 0.07 millimeters. The material of the first insulation layer 106 affects the electrical properties of the insulated wire 100. The first insulation layer 106 is formed of a material selected from a group consisting of solid polyolefin, polypropylene and fluorinated ethylene propylene. In an embodiment of the present disclosure, polyolefin is used for forming the first insulation material 106. Utilization of polyolefin increases the crush strength of the first insulation layer 102. Also, the utilization of fluorinated ethylene propylene provides an insulation that is extremely resistant to invasion by contaminants, including water.

The first insulation layer 106 includes a first circumferential wall 106*a* and a second circumferential wall 106*b*. In an embodiment of the present disclosure, the first circumferential wall 106*a* is an outer wall defining the outer surface of the first insulation layer 106. The second circumferential wall 106*b* is spaced radially inwardly from the first circumferential wall. In an embodiment of the present disclosure, the second circumferential wall 106*b* is an inner wall defining the inner surface of the first insulation layer 106. Further, the second circumferential wall 106*b* is spaced at a first radial distance from the first circumferential wall 106*a*. The first radial distance between the first circumferential wall 106*a* and the second circumferential wall 106*b* defines the first radial thickness of the first insulation layer 106. In an embodiment of the present disclosure, the first radial distance between the first circumferential wall 106*a* and the second circumferential wall 106*b* is about 0.015 millimeters.

Further, the first insulation layer 106 defines a plurality of channels 108 disposed around the peripheral surface 102*b* of the conductor 102. According to the specific cable size requirements, a pre-defined number of channels are disposed around the peripheral surface 102*b* of the conductor 102. In an embodiment of the present disclosure, the plurality of channels 108 disposed around the peripheral surface 102*b* of the conductor 102 is in a number range of about 3 to 12.

Each of the plurality of channels 108 is filled with a filler material having a low dielectric constant. In general, the dielectric constant is a ratio of a permittivity of a substance to a permittivity of free space. In an embodiment of the present disclosure, the filler material is air having a dielectric constant of one. In another embodiment of the present disclosure, the filler material is nitrogen. In yet another embodiment of the present disclosure, the filler material is carbon dioxide. In another embodiment of the present disclosure, the filler material is any suitable material with low dielectric constant. In general, the dielectric constant associated the first insulation layer 106 is proportional to a cross-sectional area of each of the plurality of channels 108. The cross-sectional shape of each of the plurality of channels 108 is selected to maximize the cross-sectional area of each of the plurality of channels 108 while maintaining mechanical strength of the insulated wire 100. In an embodiment of the present disclosure, the plurality of channels 108 has a cross-sectional shape selected from a group consisting of sinusoidal, semicircular, square, rectangular, trapezoidal and arched.

Referring to FIG. 2, each of the plurality of channels 108 is defined between the second circumferential wall 106*b* and the peripheral surface 102*b* of the conductor 102. Each of the plurality of channels 108 includes at least two walls. In an embodiment of the present disclosure, each of the plurality of channels 108 has an almost trapezoidal shaped cross-section defined by four walls. The four walls defining each of the plurality of channels 108 includes the second circumferential wall 106*b*, the peripheral surface 102*b*, a first side wall 202 and a second side wall 204. The second circumferential wall 106*b* and the peripheral surface 102*b* are faced radially inwardly towards the longitudinal axis of the conductor 102.

The first side wall 202 extends outwardly from the peripheral surface 102*b*. In addition, the second side wall 204 extends outwardly from the peripheral surface 102*b* and disposed in a non-parallel relation with the first side wall 202. Further, the second circumferential wall 106*b* of the first insulation layer 106 interconnects the first side wall 202 and the second side wall 204. In an embodiment of the present disclosure, the second circumferential wall 106*b* of the first insulation layer 106 interconnects the first side wall 202 and the second side wall 204 at a location disposed radially outwardly in a spaced relation to the peripheral surface 102*b*.

Continuing with FIG. 1, the insulation 104 includes the second insulation layer 110 disposed circumferentially around the first insulation layer 106. In an embodiment of the present disclosure, the second insulation layer 110 is disposed such that the second insulation layer 110 is in substantially continuous contact with the first circumferential wall 106*a* of the first insulation layer 106. The second insulation layer 110 is a foamed polymeric layer surrounding the first insulation layer 106. The second insulation layer 110 is made of the foamed polymeric material foamed to a density of about 12% to 70% of that of a solid polymeric material. Foaming of an insulation material reduces the dielectric constant by introducing air within the material. In general, speed of signal transmission is inversely proportional to the dielectric constant of the insulation. Therefore, disposition of the second insulation layer 110 over the first insulation layer 106 improves and permits faster signal transmission within the insulated wire 100. In an embodiment of the present disclosure, the second insulation layer 110 is formed of a material selected from a group consisting of polyolefin, polypropylene and fluorinated ethylene propylene. Moreover, the second insulation layer 110 has a second radial thickness in a range of about 0.17 millimeters to 0.3 millimeters.

Further, the insulation 104 includes the third insulation layer 112 disposed circumferentially around the second insulation layer 110. In an embodiment of the present disclosure, the third insulation layer 112 is disposed such that the third insulation layer 112 is substantially in continuous contact with the second insulation layer 110. The third insulation layer 112 is formed of a material selected from a group consisting of solid polyolefin, polypropylene and fluorinated ethylene propylene. Moreover, the third insulation layer 112 has a third radial thickness in a range of about 0.01 millimeters to 0.07 millimeters.

FIG. 3 illustrates a cross sectional view of a telecommunications cable 300, in accordance with an embodiment of the present disclosure. In general, the telecommunications cable 300 is a type of guided transmission media that allows baseband transmissions from a transmitter to a receiver. In addition, the telecommunications cable 300 is utilized for mass data transmission of local area network. Moreover, the telecommunications cable 300 is used for high speed data rate transmission. The high speed data rate transmission includes 1000BASE-T (Gigabit Ethernet) and 10 GBASE-T (10-Gigabit Ethernet) or other standards. The telecommunications cable 300 is used for a wide variety of applications. The telecommunications cable 300 transmits data at a plurality of operational frequencies. The plurality of operational frequencies is in the range of about 1 Megahertz (hereinafter as MHz) to 2000 MHz.

The telecommunications cable 300 is an unshielded twisted pair telecommunication cable. In general, the unshielded twisted pair telecommunication cable is a cable with two conductors of a single circuit twisted together. The electrical conductors are twisted together for the purposes of canceling out electromagnetic interference from internal and external sources. The telecommunications cable 300 is associated with a longitudinal axis (not shown in figure). The longitudinal axis of the telecommunications cable 300 passes through the geometrical center of the cross section of the telecommunications cable 300.

The telecommunications cable 300 includes a plurality of twisted pairs of insulated wires 302*a-d*, a separator 304, a first layer 308, a ripcord 310 and plurality of identification stripes 312*a-d*. Each of the plurality of twisted pairs of insulated wires 302*a-d* includes a plurality of insulated wires 100 (of FIG. 1) incorporated into the telecommunication cable 300. Each insulated wire 100 of the plurality of insulated wires includes a conductor 102 and insulation 104 surrounding the conductor 102 (as described above in the detailed description of FIG. 1). The insulation 104 includes a first insulation layer 106, a second insulation layer 110 and a third insulation layer 112. The first insulation layer 106, the second insulation layer 110 and the third insulation layer 112 together provides electrical isolation to the conductor 102. In an embodiment of the present disclosure, the insulation 104 has a pre-defined overall insulation thickness in a range of about 0.19 millimeters to 0.44 millimeters.

The above combination of structural elements enables an improvement in a plurality of characteristics of the telecommunications cable 300. The plurality of characteristics includes electrical characteristics and transmission characteristics. The electrical characteristics include input impedance, propagation delay and delay skew. The transmission characteristics include insertion loss, return loss and alien cross talk. In general, the input impedance is the ratio of the amplitudes of voltage and current of a wave travelling in one direction in the absence of reflections in the other direction. In an embodiment of the present disclosure, the input impedance of the telecommunications cable 300 is 100 ohm±15 ohm. In another embodiment of the present disclosure, the telecommunications cable 300 has any other suitable value of input impedance.

In general, the propagation delay is equivalent to an amount of time that passes between when a signal is transmitted and when it is received on the other end of a cabling channel. In an embodiment of the present disclosure, the propagation delay for the telecommunications cable 100 is up to 5.7 nanosecond per meter at a frequency of 1 MHz. In general, the delay skew is a difference in propagation delay between any two conductor pairs within the same cable. In an embodiment of the present disclosure, the delay skew of the telecommunications cable 100 is less than 45 nanoseconds. In another embodiment of the present disclosure, the telecommunications cable 300 has any other suitable value of the delay skew.

In general, the insertion loss known as "attenuation" refers to reduction in the strength of a signal travelling through the telecommunications cable 300. Factors affecting the insertion loss of the telecommunication cable 300 include but may not be limited to cable length, temperature, conductor size and the like. In an embodiment of the present disclosure, the insertion loss of the telecommunication cable (Cat 6A) is at most 2.08 decibels per 100 meters at a frequency of 1 MHz.

In general, the return loss is the measurement of the amount of signal that is reflected back toward the transmitter. The return loss in the telecommunication cable 300 occurs due to a change in impedance in a twisted pairs of insulated wires 100. The change in impedance is caused due to a plurality of factors. The plurality of factors include but may not be limited to cable manufacturing process, cable termination at the far end and damage due to tight bends during installation. In an embodiment of the present disclosure, the return loss of the telecommunication cable 300 is at least 20 decibel at a frequency of 1 MHz.

In general, the alien crosstalk is electromagnetic noise occurring in a telecommunications cable 300 running alongside one or more other signal-carrying cables. The term "alien" is used as alien crosstalk occurs between different cables in a group or bundle and not between individual wires or circuits within a single cable. In an embodiment of the present disclosure, the telecommunication cable 300 has power sum alien near end cross talk of 67 decibels at a frequency of about 1 MHz. In another embodiment of the present disclosure, the telecommunication cable 300 has any other suitable value of alien cross talk.

Continuing with FIG. 3, the telecommunication cable 300 includes the plurality of twisted pairs of insulated wires 302*a-d*. Each of the plurality of twisted pairs of insulated wires 302*a-d* extends substantially along a longitudinal axis of the telecommunications cable 300. In an embodiment of the present disclosure, each of the plurality of twisted pairs of insulated wires 302*a-d* is helically twisted along a length of the plurality of twisted pairs of insulated wires 302*a-d*. Each insulated wire 100 of the plurality of twisted pairs of insulated wires 302*a-d* is helically twisted to minimize the transmission losses in the telecommunications cable 300. In an embodiment of the present disclosure, a number of the plurality of twisted pairs of insulated wires 302*a-d* is four. In another embodiment of the present disclosure, the number of the plurality of twisted pairs of insulated wires 302*a-d* may vary.

Each of the four twisted pair of insulated wires 302*a-d* includes two insulated wires twisted together and extended along a length of the telecommunication cable 300. In addition, each insulated wire 100 (as shown in FIG. 1) includes the conductor 102 surrounded by the insulation 104. The insulation 104 includes the first insulation layer 106, the second insulation layer 110 and the third insulation layer 112 (as shown in FIG. 1). The first insulation layer 106, the second insulation layer 110 and the third insulation layer 112 together provides electrical isolation to the conductor 102. The first insulation layer 106 surrounds the peripheral surface 102*b* of the conductor 102. The first insulation layer 106 defines the plurality of channels 108 disposed around the peripheral surface 102*b* of the conductor 102 (as explained in the detailed description of FIG. 1).

The cross-sectional shape of each of the plurality of channels 108 is selected to maximize the cross-sectional area of each of the plurality of channels 108 while maintaining mechanical strength of the insulated wire 100. In an embodiment of the present disclosure, each of the plurality of channels 108 has an almost trapezoidal shaped cross-section defined by four walls. The trapezoidal shaped channels reduce the dielectric constant of the insulation 104. Further, each of the plurality of channels 108 is defined by four walls. The four walls defining each of the plurality of channels 108 includes the second circumferential wall 106*b*, the peripheral surface 102*b*, a first side wall 202 and a second side wall 204 (as described in the detailed description of FIG. 1 and FIG. 2). Also, each of the plurality of channels 108 is filled with a filler material having low dielectric constant. In an embodiment of the present disclosure, the filler material is air having a dielectric constant of one. In another embodiment of the present disclosure, the filler material is any suitable material having low dielectric constant.

Further, the first insulation layer 106 is surrounded by the second insulation layer 110. The second insulation layer 110 is disposed circumferentially around the first insulation layer 106. In addition, the second insulation layer 110 is formed of a material selected from a group consisting of solid or foamed polyolefin, solid or foamed polypropylene and fluorinated ethylene propylene. Furthermore, the second insulation layer 110 is surrounded by the third insulation layer 112. The third insulation layer 112 is disposed circumferentially around the second insulation layer 110. In addition, the third insulation layer 112 is formed of a material selected from a group consisting of solid polyolefin, polypropylene and fluorinated ethylene propylene (as discussed above in the detailed description of FIG. 1).

The telecommunication cable 300 includes the separator 304. The separator 304 lies substantially along the longitudinal axis of the telecommunication cable 300. The separator 304 is placed at the center of the telecommunication cable 300. In an embodiment of the present disclosure, the center of the separator 304 lies on the longitudinal axis of the telecommunication cable 300. The separator 304 separates each twisted pair of insulated wires from the rest of the twisted pairs of insulated wires. The separator 304 is suitably designed, such that it divides the core of the telecommunication cable 300 into plurality of separate sections of area. In an embodiment of the present disclosure, the separator 304 is of cross or plus shape. In an embodiment of the present disclosure, the separator 304 is of I shape. In another embodiment of the present disclosure, the separator 304 is of T shape. In yet another embodiment of the present disclosure, the separator 304 is of any other suitable shape.

The separator 304 divides a space within the telecommunication cable 300 into at least two area sections. In an embodiment of the present disclosure, the separator 304 divides the space within the telecommunication cable 300 into four area sections. The four area sections include a first area section 306*a*, a second area section 306*b*, a third area section 306*c* and a fourth area section 306*d*. In an embodiment of the present disclosure, the first area section 306*a*, the second area section 306*b*, the third area section 306*c* and the fourth area section 306*d* have equal cross sectional area. In another embodiment of the present disclosure, the first area section 306*a*, the second area section 306*b*, the third area section 306*c* and the fourth area section 306*d* have unequal cross sectional area. Each area section of the four area sections 306*a-d* provides housing space for each of the plurality of twisted pairs of insulated wires 302. Each area section of the four area sections 306*a-d* includes one pair of twisted insulated wires. In an embodiment of the present disclosure, the separator 304 is made of a material selected from a group consisting of polypropylene, PVC (polyvinyl chloride), polyolefin, fluorinated ethylene propylene and low smoke zero halogen material.

The telecommunication cable 300 includes the first layer 308. In an embodiment of the present disclosure, the first layer 308 is a cable jacket. The first layer 308 surrounds the plurality of twisted pairs of insulated wires and extends substantially along the longitudinal axis of the telecommunication cable 300. The first layer 308 is the outer layer of the telecommunication cable 300. The first layer 308 is the protective outer covering for the telecommunication cable 300. The first layer 308 provides thermal, mechanical and electrical insulation to the telecommunication cable 300. The first layer 308 protects the telecommunication cable 300 from moisture, water, insects, abrasion, magnetic fields, radiations, and the like.

The first layer 308 is made of a material selected from a group of low smoke zero halogen material, polyolefin and PVC. In general, polyvinyl chloride is a synthetic resin made from polymerization of vinyl chloride. In general, polyolefin is a light versatile synthetic resin made from the polymerization of ethylene. In an embodiment of the present disclosure, the first layer 308 is made of fire retardant poly vinyl chloride. In another embodiment of the present disclosure, the first layer 308 is made of fluoropolymer. Further, the first layer 308 has a pre-defined thickness. In an embodiment of the present disclosure, the pre-defined thickness of the first layer 308 is in a range of about 0.4 millimeters to 1.9 millimeters. Also, the pre-defined thickness of the first layer 308 defines an inner diameter and the outer diameter of the telecommunication cable 300. In an embodiment of the present disclosure, the inner diameter of the telecommunication cable 300 is in a range of about 4 millimeters to 8 millimeters. In an embodiment of the present disclosure, the outer diameter of the telecommunication cable 300 is in a range of about 5 millimeters to 9 millimeters.

Further, the telecommunications cable 300 includes one or more ripcords. In an embodiment of the present disclosure, the telecommunications cable 300 includes a ripcord 310. The one or more ripcords are placed inside a core of the telecommunications cable 300. The one or more ripcords lie substantially along the longitudinal axis of the telecommunications cable 300. The one or more ripcords facilitate stripping of the first layer 308. In an embodiment of the present disclosure, the one or more ripcords are made of a material selected from a group consisting of nylon and polyester based twisted yarns.

In an embodiment of the present disclosure, the telecommunications cable 300 includes a plurality of identification stripes 312*a-d*. Each identification stripe is located on the insulation 104 of one insulated wire in each area section. Each of the plurality of identification stripes 312*a-d* is used for identification of each twisted pair of insulated wire. In an embodiment of the present disclosure, the insulation of each of the plurality of twisted pairs of insulated wires in each of the four area section is colored. The color of the insulation of one insulated wire of the two insulated wires in each of the four area sections is selected from a group. The group includes white, blue, orange, green and brown.

The present disclosure provides ample advantages over the prior art. The present disclosure provides an increased electrical stability during the high frequency signal transmission. The present disclosure provides the insulation which reduces the transmission losses like propagation delay, delay skew, insertion loss and return loss. The present disclosure enables a high speed signal transmission with improved physical and transmission characteristics. In addition, the present disclosure provides a telecommunication cable of reduced size thus enabling the telecommunication cable more acceptable in the market.

The foregoing descriptions of specific embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

While several possible embodiments of the invention have been described above and illustrated in some cases, it should be interpreted and understood as to have been presented only by way of illustration and example, but not by limitation. Thus, the breadth and scope of a preferred embodiment should not be limited by any of the above-described exemplary embodiments.

What is claimed is:

1. An insulation for a conductor, wherein the insulation comprising:

a first insulation layer defining a plurality of channels disposed around a peripheral surface of the conductor, wherein the first insulation layer comprises a first circumferential wall and a second circumferential wall spaced radially inwardly from the first circumferential wall, wherein the plurality of channels is defined between the second circumferential wall and the peripheral surface of the conductor;

a second insulation layer disposed circumferentially around the first insulation layer; and a third insulation layer disposed circumferentially around the second insulation layer.

2. The insulation as recited in claim 1, wherein the first insulation layer is formed of a material selected from a group consisting of solid polyolefin, polypropylene and fluorinated ethylene propylene and wherein the first insulation layer has a first radial thickness in a range of about 0.01 millimeters to 0.07 millimeters.

3. The insulation as recited in claim 1, wherein the second insulation layer is formed of a material selected from a group consisting of solid or foamed polyolefin, solid or foamed polypropylene and fluorinated ethylene propylene and wherein the second insulation layer has a second radial thickness in a range of about 0.17 millimeters to 0.3 millimeters.

4. The insulation as recited in claim 1, wherein the third insulation layer is formed of a material selected from a group consisting of solid polyolefin, polypropylene and fluorinated ethylene propylene and wherein the third insulation layer has a third radial thickness in a range of about 0.01 millimeters to 0.07 millimeters.

5. The insulation as recited in claim 1, wherein each of the plurality of channels has a cross-sectional shape selected from a group consisting of sinusoidal, semicircular, square, rectangular, trapezoidal and arched.

6. The insulation as recited in claim 1, wherein the plurality of channels disposed around the peripheral surface of the conductor is in a number range of about 3 to 12.

7. The insulation as recited in claim 1, wherein the second insulation layer is disposed around the first insulation layer such that the second insulation layer is in substantially continuous contact with the first circumferential wall of the first insulation layer.

8. A telecommunication cable comprising:

a plurality of twisted pairs of insulated wires extending substantially along a longitudinal axis of the telecommunications cable, wherein each insulated wire of the plurality of twisted pairs of insulated wires comprises:

at least one conductor, wherein the conductor is made of copper;

an insulation surrounding the conductor, wherein the insulation comprises a first insulation layer defining a plurality of channels disposed around a peripheral surface of the conductor, a second insulation layer disposed circumferentially around the first insulation layer, a third insulation layer disposed circumferentially around the second insulation layer, wherein the first insulation layer comprises a first circumferential wall and a second circumferential wall spaced radially inwardly from the first circumferential wall, wherein the plurality of channels is defined between the second circumferential wall and the peripheral surface of the conductor;

a separator for separating each twisted pair of insulated wire of the plurality of twisted pairs of insulated wires; and a first layer surrounding the separator and the plurality of twisted pairs of insulated wires along the length of the telecommunications cable.

9. The telecommunication cable as recited in claim 8, wherein the conductor has a cross sectional diameter in a range of about 0.49 millimeters to 0.69 millimeters.

10. The telecommunication cable as recited in claim 8, wherein the first insulation layer is formed of a material selected from a group consisting of solid polyolefin, polypropylene and fluorinated ethylene propylene, wherein the first insulation layer has a first radial thickness in a range of about 0.01 millimeters to 0.07 millimeters.

11. The telecommunication cable as recited in claim 8, wherein the second insulation layer is formed of a material selected from a group consisting of solid or foamed polyolefin, solid or foamed polypropylene and fluorinated ethylene propylene, wherein the second insulation layer has a second radial thickness in a range of about 0.17 millimeters to 0.3 millimeters.

12. The telecommunication cable as recited in claim 8, wherein the third insulation layer is formed of a material selected from a group consisting of solid polyolefin, polypropylene and fluorinated ethylene propylene and wherein the third insulation layer has a third radial thickness in a range of about 0.01 millimeters to 0.07 millimeters.

13. The telecommunication cable as recited in claim 8, further comprising one or more ripcords placed inside a core of the telecommunications cable and lying substantially along the longitudinal axis of the telecommunications cable, the one or more ripcords facilitate stripping of the first layer, wherein the one or more ripcords is made of a material selected from a group consisting of nylon and polyester based twisted yarns.

14. The telecommunication cable as recited in claim 8, wherein each of the plurality of channels between the second circumferential wall and the peripheral surface of the conductor defines a void space containing at least one of air, nitrogen and carbon dioxide.

15. The telecommunication cable as recited in claim 8, wherein the telecommunication cable has a cross-sectional outer diameter in a range of 5 millimeters to 9 millimeters.

16. The telecommunication cable as recited in claim 8, wherein the plurality of channels has a cross-sectional shape selected from a group consisting of sinusoidal, semicircular, square, rectangular, trapezoidal and arched.

17. The telecommunication cable as recited in claim 8, wherein the plurality of channels disposed around the peripheral surface of the conductor is in a number range of about 3 to 12.

18. An insulation for conductor, wherein the insulation comprising:

a first insulation layer defining a plurality of channels disposed around a peripheral surface of the conductor, wherein the first insulation layer comprises a first circumferential wall and a second circumferential wall spaced radially inwardly from the first circumferential wall, wherein the plurality of channels is defined between the second circumferential wall and the peripheral surface of the conductor, wherein the first insulation layer is formed of a material selected from a group consisting of solid polyolefin, polypropylene and fluorinated ethylene propylene and wherein the first insulation layer has a first radial thickness in a range of about 0.01 millimeters to 0.07 millimeters;

a second insulation layer disposed circumferentially around the first insulation layer, wherein the second insulation layer is formed of a material selected from a group consisting of solid or foamed polyolefin, solid or foamed polypropylene and fluorinated ethylene propylene and wherein the second insulation layer has a second radial thickness in a range of about 0.17 millimeters to 0.3 millimeters; and a third insulation layer disposed circumferentially around the second insulation layer, wherein the third insulation layer is formed of a material selected from a group consisting of solid polyolefin, polypropylene and fluorinated ethylene propylene and wherein the third insulation layer has a third radial thickness in a range of about 0.01 millimeters to 0.07 millimeters.

19. The insulation as recited in claim 18, wherein each of the plurality of channels has a cross-sectional shape selected from a group consisting of sinusoidal, semicircular, square, rectangular, trapezoidal and arched.

20. The insulation as recited in claim 18, wherein the plurality of channels disposed around the peripheral surface of the conductor is in a number range of about 3 to 12.

21. The insulation as recited in claim 18, wherein the second insulation layer is disposed around the first insulation layer such that the second insulation layer is in substantially continuous contact with the first circumferential wall of the first insulation layer.

22. A telecommunication cable comprising:

a plurality of twisted pairs of insulated wires extending substantially along a longitudinal axis of the telecommunications cable, wherein each insulated wire of the plurality of twisted pairs of insulated wires comprises:

at least one conductor, wherein the conductor is made of copper and wherein the conductor has a cross sectional diameter in a range of about 0.49 millimeters to 0.69 millimeters; and an insulation surrounding the conductor, wherein the insulation comprises a first insulation layer defining a plurality of channels disposed around a peripheral surface of the conductor, a second insulation layer disposed circumferentially around the first insulation layer, a third insulation layer disposed circumferentially around the second insulation layer, wherein the first insulation layer comprises a first circumferential wall and a second circumferential wall spaced radially inwardly from the first circumferential wall, wherein the plurality of channels is defined between the second circumferential wall and the peripheral surface of the conductor, wherein the first insulation layer is formed of a material selected from a group consisting of solid polyolefin, polypropylene and fluorinated ethylene propylene, wherein the first insulation layer has a first radial thickness in a range of about 0.01 millimeters to 0.07 millimeters, wherein the second insulation layer is formed of a material selected from a group consisting of solid or foamed polyolefin, solid or foamed polypropylene and fluorinated ethylene propylene, wherein the second insulation layer has a second radial thickness in a range of about 0.17 millimeters to 0.3 millimeters, wherein the third insulation layer is formed of a material selected from a group consisting of solid polyolefin, polypropylene and fluorinated ethylene propylene and wherein the third insulation layer has a third radial thickness in a range of about 0.01 millimeters to 0.07 millimeters;

a separator for separating each twisted pair of insulated wire of the plurality of twisted pairs of insulated wires; and a first layer surrounding the separator and the plurality of twisted pairs of insulated wires along the length of the telecommunications cable.

23. The telecommunication cable as recited in claim 22, further comprising one or more ripcords placed inside a core of the telecommunications cable and lying substantially along the longitudinal axis of the telecommunications cable, the one or more ripcords facilitate stripping of the first layer, wherein the one or more ripcords is made of a material selected from a group consisting of nylon and polyester based twisted yarns.

24. The telecommunication as recited in claim 22, wherein each of the plurality of channels between the second circumferential wall and the peripheral surface of the conductor defines a void space containing at least one of air, nitrogen and carbon dioxide.

25. The telecommunication cable as recited in claim 22, wherein the telecommunication cable has a cross-sectional outer diameter in a range of 5 millimeters to 9 millimeters.

26. The telecommunication cable as recited in claim 22, wherein the plurality of channels has a cross-sectional shape selected from a group consisting of sinusoidal, semicircular, square, rectangular, trapezoidal and arched.

27. The telecommunication cable as recited in claim 22, wherein the plurality of channels disposed around the peripheral surface of the conductor is in a number range of about 3 to 12.

28. An insulation for conductor, wherein the insulation comprising:

a first insulation layer defining a plurality of channels disposed around a peripheral surface of the conductor, wherein the first insulation layer comprises a first circumferential wall and a second circumferential wall spaced radially inwardly from the first circumferential wall, wherein the plurality of channels is defined between the second circumferential wall and the peripheral surface of the conductor, wherein each of the plurality of channels has a cross-sectional shape selected from a group consisting of sinusoidal, semicircular, square, rectangular, trapezoidal and arched, wherein the plurality of channels disposed around the peripheral surface of the conductor is in a number range of about 3 to 12, wherein the first insulation layer is formed of a material selected from a group consisting of solid polyolefin, polypropylene and fluorinated ethylene propylene and wherein the first insulation layer has a first radial thickness in a range of about 0.01 millimeters to 0.07 millimeters;

a second insulation layer disposed circumferentially around the first insulation layer, wherein the second insulation layer is disposed around the first insulation layer such that the second insulation layer is in substantially continuous contact with the first circumferential wall of the first insulation layer, wherein the second insulation layer is formed of a material selected from a group consisting of solid or foamed polyolefin, solid or foamed polypropylene and fluorinated ethylene propylene and wherein the second insulation layer has a second radial thickness in a range of about 0.17 millimeters to 0.3 millimeters; and a third insulation layer disposed circumferentially around the second insulation layer, wherein the third insulation layer is formed of a material selected from a group consisting of solid polyolefin, polypropylene and fluorinated ethylene propylene and wherein the third insulation layer has a third radial thickness in a range of about 0.01 millimeters to 0.07 millimeters.

29. A telecommunication cable comprising:

a plurality of twisted pairs of insulated wires extending substantially along a longitudinal axis of the telecommunications cable, wherein each insulated wire of the plurality of twisted pairs of insulated wires comprises:

at least one conductor, wherein the conductor is made of copper and wherein the conductor has a cross sectional diameter in a range of about 0.49 millimeters to 0.69 millimeters; and an insulation surrounding the conductor, wherein the insulation comprises a first insulation layer defining a plurality of channels disposed around a peripheral surface of the conductor, a second insulation layer disposed circumferentially around the first insulation layer, a third insulation layer disposed circumferentially around the second insulation layer, wherein the first insulation layer comprises a first circumferential wall and a second circumferential wall spaced radially inwardly from the first circumferential wall, wherein the plurality of channels is defined between the second circumferential wall and the peripheral surface of the conductor, each of the plurality of channels between the second circumferential wall and the peripheral surface of the conductor defines a void space containing at least one of air, nitrogen and carbon dioxide, wherein the plurality of channels has a cross-sectional shape selected from a group consisting of sinusoidal, semicircular, square, rectangular, trapezoidal and arched, wherein the plurality of channels disposed around the peripheral surface of the conductor is in a number range of about 3 to 12, wherein the first insulation layer is formed of a material selected from a group consisting of solid polyolefin, polypropylene and fluorinated ethylene propylene, wherein the first insulation layer has a first radial thickness in a range of about 0.01 millimeters to 0.07 millimeters, wherein the second insulation layer is formed of a material selected from a group consisting of solid or foamed polyolefin, solid or foamed polypropylene and fluorinated ethylene propylene, wherein the second insulation layer has a second radial thickness in a range of about 0.17 millimeters to 0.3 millimeters, wherein the third insulation layer is formed of a material selected from a group consisting of solid polyolefin, polypropylene and fluorinated ethylene propylene and wherein the third insulation layer has a third radial thickness in a range of about 0.01 millimeters to 0.07 millimeters;

a separator for separating each twisted pair of insulated wire of the plurality of twisted pairs of insulated wires; and a first layer surrounding the separator and the plurality of twisted pairs of insulated wires along the length of the telecommunications cable, wherein the telecommunication cable has a cross-sectional outer diameter in a range of 5 millimeters to 9 millimeters.

30. The telecommunication cable as recited in claim 29, further comprising one or more ripcords placed inside a core of the telecommunications cable and lying substantially along the longitudinal axis of the telecommunications cable, the one or more ripcords facilitate stripping of the first layer, wherein the one or more ripcords is made of a material selected from a group consisting of nylon and polyester based twisted yarns.

* * * * *